United States Patent [19]

McAlister

[11] Patent Number: 4,824,431

[45] Date of Patent: Apr. 25, 1989

[54] CENTRIFUGAL CONCENTRATOR

[76] Inventor: Steven A. McAlister, 32778 Bellvue Crescent, Clearbrook, B.C., Canada, V2S 5K3

[21] Appl. No.: 2,805

[22] Filed: Jan. 13, 1987

[51] Int. Cl.[4] ..... B04B 1/02

[52] U.S. Cl. ..... 494/43; 494/65

[58] Field of Search ..... 494/60, 43, 50, 63, 494/65, 85, 56; 209/199; 210/360.1

[56] References Cited

U.S. PATENT DOCUMENTS

| | | | |
|---|---|---|---|
| 444,619 | 1/1891 | Peck . | |
| 489,101 | 1/1893 | Seymour . | |
| 585,552 | 6/1897 | Bushby . | |
| 648,111 | 4/1900 | Nilsson | 494/43 |
| 685,005 | 10/1901 | Palmer . | |
| 881,013 | 3/1908 | Manley . | |
| 946,444 | 1/1910 | Jones . | |
| 1,443,608 | 1/1923 | Bleakley . | |
| 1,767,893 | 6/1930 | Neumann | 209/199 |
| 2,146,716 | 2/1939 | Bennett | 209/199 |
| 3,350,296 | 10/1967 | Torobin | 494/65 |
| 4,067,494 | 1/1978 | Willus | 494/43 |
| 4,286,748 | 9/1981 | Bailey | 494/29 |

*Primary Examiner*—Robert W. Jenkins

*Attorney, Agent, or Firm*—Spensley Horn Jubas & Lubitz

[57] ABSTRACT

Prior centrifugal concentrators for concentrating precious minerals use annular ribs or baffles to trap the precious minerals. Sand or magnetite tends to pack against such ribs, reducing the effectiveness of these devices. In the present invention, the inner surface of the rotating drum is free of obstacles, but forms three continuous zones, a migration zone, a retention zone and a lip zone. The precious mineral is retained in the retention zone by centrifugal force and friction while the unwanted slurry flows over the retention zone and out of the drum.

10 Claims, 3 Drawing Sheets

CENTRIFUGAL CONCENTRATOR

BACKGROUND OF THE INVENTION

The present invention relates to concentrators for concentrating particles of different specific gravities and more particularly to centrifugal concentrators for concentrating minerals such as gold ore from a slurry.

It is common to use centrifugal force to separate out heavier metal ores, such as gold, from lighter material, such as tailings or a slurry comprised largely of sand. This is commonly accomplished using a rotating drum into which the particulate material containing gold is introduced. The gold, having a greater specific gravity than the other particulate material, migrates to the outer layer of the slurry and is removed by various methods. For example, U.S. Pat. No. 585,552 issued June 29, 1897 to Bushby, discloses an ore separator in which the ore is fed into a rotating bowl. Centrifugal force causes the ore to climb the sides of the bowl. At the point of largest diameter of the bowl the particles are stratified, with the precious mineral of high specific gravity nearer the surface of the bowl. Bushby utilizes two adjacent funnels with associated scrapers, arranged at different distances from the axis of rotation, with the first funnel nearest the wall of the bowl, to constantly separate the materials and convey the saved ore to a separate location. Due to the continuous nature of the Bushby separation process, this design fails to provide a sufficiently high concentration of gold in saved material to be commercially feasible for most applications. Also the scraper arrangement is prone to plugging and is subjected to extreme abrasion.

In other devices annular ribs or baffles are provided on the inclined side walls of the rotating drum to collect the heavier mineral particles and thereby provide sufficient yield. In some instances, a supply of mercury would be contained in the rotating drum by flanges to amalgamate gold which collected in it. For example, in the concentrator disclosed in U.S. Pat. No. 4,286,748 issued Sept. 1, 1981 to Bailey, the gold is collected in grooves in the wall of the rotating drum which are defined by annular baffles on the side wall and which impede the migration of the heavier particles up the wall of the drum. From time to time the process is stopped to collect the accumulated gold. The problem with such devices is that the fine particles quickly pack the area of obstruction thus preventing the accumulation of mineral as desired. Various solutions to the problem of packing have been attempted, such as imparting an occilating or bumping movement to the bowl, but none has provided a practical centrifugal concentrator which avoids the problem of packing.

SUMMARY OF THE INVENTION

The present invention provides a centrifugal concentrator which avoids packing by eliminating obstacles to the flow of the slurry in the rotating drum. Rather than relying on ridges or grooves to capture the precious mineral, the present invention relies on the stratification of the slurry to form a layer of heavier particles which is retained in a zone of the drum by friction created by centrifugal force.

The present invention comprises a concentrator for separating particulate material of higher specific gravity from particulate material of lower specific gravity, comprising a hollow drum having an open end and an interior surface, means for rotatably supporting the drum on an axis, drive means for rotating the drum about the axis, and a material supply means to deliver the particulate material into the end of the drum spaced from the open end. The interior surface of the drum includes an outwardly inclined migration zone, a retention zone above the migration zone which is substantially parallel to the axis of rotation and an inwardly inclined lip zone above the retention zone. The respective lengths of the migration, retention and lip zones, and the relative degrees of inclination of the migration and lip zones are selected to provide a sufficient component of force on the particulate matter to expel the lighter matter from the drum and to permit heavier particulate matter to migrate to and be retained in the retention zone. The interior surface of the drum is preferably free of obstacles to the slurry to avoid packing.

BRIEF DESCRIPTION OF THE DRAWINGS

In drawings which illustrate an embodiment of the invention.

DETAILED DESCRIPTION OF A PREFERRED EMBODIMENT OF THE INVENTION

Figure 1:
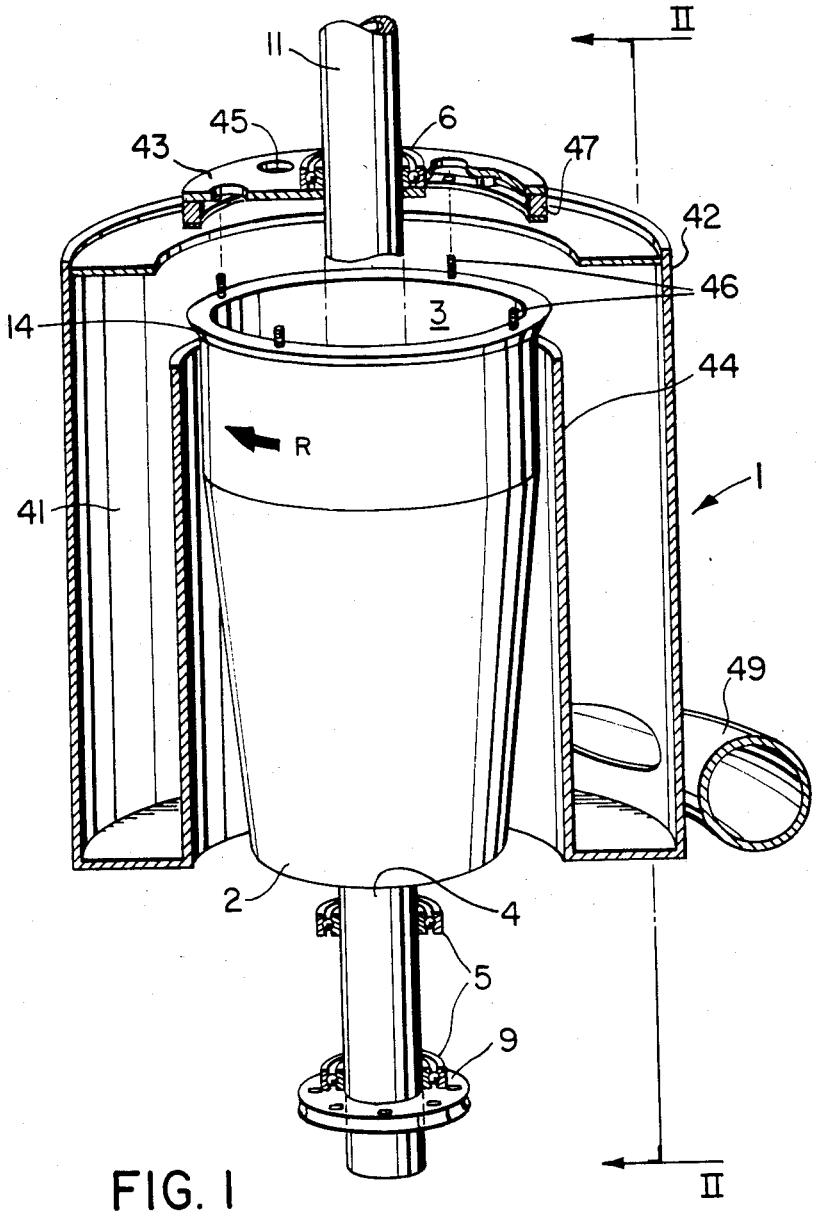
FIG. 1 is a perspective view (not to scale) of the concentrator of the invention with the external chamber partially cut away and the cover of the bowl raised.
Figure 2:
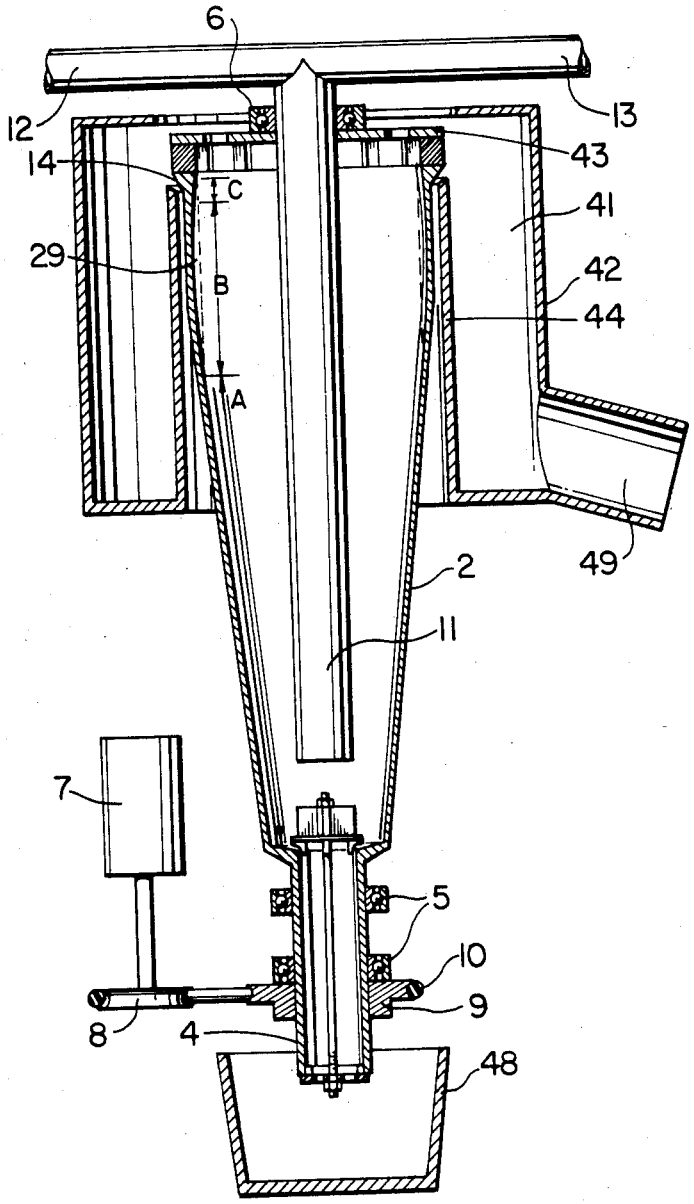
FIG. 2 is a cross-sectional view taken along lines II—II of FIG. 1.

Referring to FIGS. 1 and 2, the centrifugal concentrator of the invention is designated generally as 1. Vertically-aligned cylindrical drum 2 has an open top 3 and is mounted for rotation on hollow shaft 4 which rotates against lower bearings 5. A bearing 6 mounted on the top of the bowl secures the drum for rotation about feed pipe 11. Drive unit 7 shown in FIG. 2 drives a pulley and belt arrangement, formed of sheaves 8 and 9 and belt 10 to rotate the drum. Sheave 9 is secured to hollow shaft 4.

Drum 2 is surrounded by cylindrical discharge chamber 41 having an outer wall 42 and an inner wall 44. Drum 2 also has secured to it a top 43, secured by nuts and bolts or the like at 46. Top 43 has various access points 45 in the top 43 of the bowl. The top 43 also has reinforcing vanes 47. The chamber 41 formed in the device has discharge outlet 49.

Figure 3:
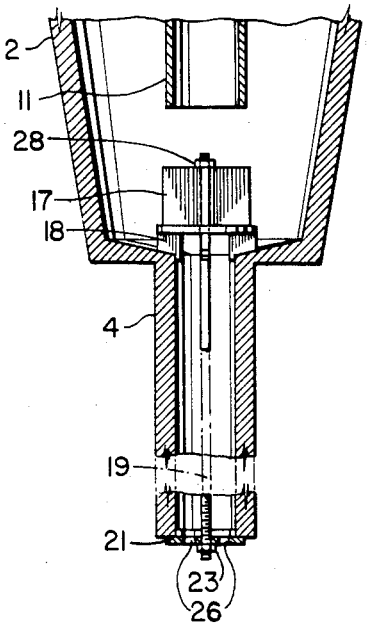
FIG. 3 is a sectional view showing the impeller of the invention.

A slurry feed of auriferous material and water is introduced into the bottom of the drum by feed conduit 11. The outlet of the feed conduit may terminate in a swirling nozzle for directing the incoming slurry substantially tangentially in the direction of rotation of the drum so that angular momentum is added to the slurry and the amount of power required to rotate the drum is reduced. The feed conduit may also be fed by two separate feed lines, a slurry feed line 12 and a water feed line 13, and the relative proportion of water and slurry entering the drum may thereby be regulated. An impeller 17 shown in greater detail in FIG. 3 is provided in its upper portion with vanes in order to act as an impeller to rotate the slurry. It is secured above the opening to hollow shaft 4 by means of support legs 18 and a threaded rod 19 which releasably connects impeller 17 to a retainer 21 using nuts 28. The passages between the support legs allow the concentrated end product to be periodically washed out of the drum when rotation of the drum is stopped. Centrifugal forces prevent material from leaving the drum through these passages when it is rotating. The retainer 21 is provided with holes 26 to allow passage of material into a concentrate receptacle. The impeller may be removed by removing one of the nuts 28 from rod 19.

Figure 4:
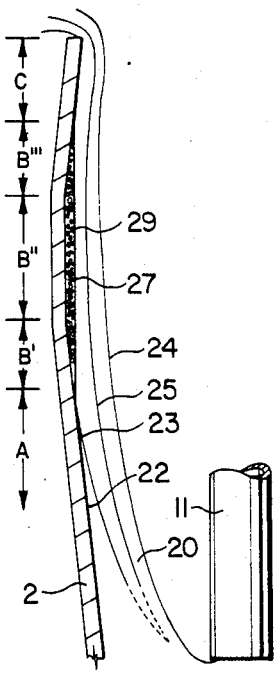
FIG. 4 is a detailed view of a portion of the wall of the concentrator shown in cross-section in FIG. 2.

Referring to FIGS. 2 and 4, the lower portion of the wall of the drum gradually diverges and is referred to as the migration zone A. A second annular portion of the upper wall of the drum, referred to as the retention zone B, has substantially vertical sides, while the upper annular area of the wall of the drum, referred to as the lip zone C, gradually converges. The upper edge of the drum may have an extending lip 14 which overhangs the inner wall 44 of discharge chamber 41. The discharge chamber is also provided with a discharge conduit 49. The hollow shaft 4 also serves to drain concentrate from the drum, and a concentrate receptacle 48 is provided to retain the concentrate.

In operation, drum 2 is rotated at a predetermined rate, in direction R and an auriferous slurry of desired consistency is continuously introduced into the bottom of the drum via feed conduit 11. The slurry is impelled to the wall of the drum and is rotated by the drum. By virtue of the geometry of the sides of the drum, described in further detail below, the rotational forces acting on the slurry cause it to migrate to the top of the drum and eventually out of the top of the drum into the discharge chamber and out the discharge conduit. The materials of highest specific gravity, such as gold, are retained in the retention zone. Once sufficient gold has been accumulated in the retention zone (which is approximately one pound in the case of a small drum), the rotation of the drum is stopped, the drum is rinsed with water, and the concentrate is washed out through the hollow shaft into a concentrate receptacle.

Referring to FIG. 4, a flow of auriferous slurry 20 is shown being swirled out of the conduit 11 against the wall of rotating drum 2. As the slurry rotates, centrifugal force, which is a function of the mass of the particle, the speed of rotation of the drum, and the radius of the particle from the axis of the drum, acts on each particle and causes the slurry to tend to form layers, with the particles having the highest specific gravity in the outside layer. The inner surface of the wall of the drum is shown as 22, the zone in which the layer of highest specific gravity material such as gold, is situated, is shown as 23. The inner surface of the slurry is shown as 24. Normally the slurry will also be separated into a layer of solids, and an inner layer of water, due to water's low specific gravity, and the boundary of these two layers is shown as 25.

In the first few seconds of operation, a layer of particles is collected in region 27 due to the centrifugal force and the shape of drum 2. After this layer has been laid, only particles having a certain greater specific gravity will be left at 29 on the surface of the region. Eventually, only the particles of heaviest specific gravity, such as gold, will be retained in zone B, while particles of lower specific gravity will be carried out in the slurry.

Figure 5:
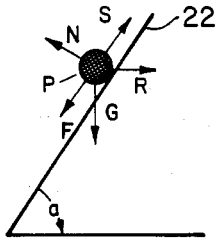
FIG. 5 is a schematic depiction of the forces acting on a particle in the migration zone.

Referring to FIG. 5, the centrifugal force R acts on particle P in a radial direction. The component of the centrifugal force acting along surface 22, shown as S, is equal to the magnitude of the centrifugal force R multiplied by the cosine of the angle a which the migration surface 22 makes with the horizontal. The normal component of the centrifugal force is matched by the reaction N of the solid migration surface 22. Acting downwardly is the gravitational force G, which has a component along the migration zone surface. Also acting on the particle, in a direction opposite to the direction of motion of the particle, is a friction force F which is a function of the normal force of the surface N and the co-efficients of friction of the particle and the surface. The rotational speed of the drum is high enough so that the component of centrifugal force in the upward direction along the migration zone surface is great enough so that the resultant force from the combination of the various forces acting on the particle is in the direction upwardly on the migration zone surface.

In order to permit the heavier gold particles to reach the outer layer of the slurry in time to be retained in the retention zone, the particle must spend a sufficient period of time in the migration zone. Ideally, the migration time is sufficiently long that a gold particle commencing its travel up the migration zone on the interior boundary of the slurry 24 has migrated to the layer closest to the wall of the drum 23 by the time it reaches the retention zone. This time will thus depend on the amount and consistency of the slurry. The rate at which the particles migrate will also depend on the specific gravity, size and shape of the precious mineral particles and other particles in the slurry, and will depend on the diameter and slope of the bowl. The time a given particle is in the migration zone will also depend on the length of the migration zone. Thus, the dimensions and slope of the bowl will depend on the type of slurry to be processed and the rate at which it will be processed. Alternatively, the consistency of the slurry and the feed rate may be regulated to conform to a drum of given characteristics.

Retention zone B in fact consists of three subzones B′, B′ and B‴. B′ is the substantially vertical annular section of the drum wall. The surface friction in this zone is increased during the first moments of operation as low specific gravity particles are deposited. The retention zone also includes a variable portion B′ of outwardly inclined migration zone and B‴ of inwardly inclined lip zone. When a particle reaches this zone, because the surface is vertical, the upward component of centrifugal force disappears, and eventually turns into a downward component as the particle proceeds into zone B‴. The increased surface friction also tends to prevent movement, as a function of the magnitude of the centrifugal force. There is an upward force component due to friction with the particles in the outer layer of the slurry which are moving upwardly, but this is ideally balanced by the surface friction in the zone. Thus the heavier mineral particles build up in the retention zone until the frictional forces of the slurry flow overcome the combination of frictional forces in the retention zone and the downward component of centrifugal force exerted as the particle moves in an inward direction on the lip zone. Once the precious mineral particles tend to stray from the retention zone, the drum is stopped, and the concentrate washed into the concentrate receptacle.

It is apparent that a number of the variables at play in the system may be changed while making appropriate variations in one or more of the other variables. In an experimental prototype of the device, the drum had the following approximate dimensional characteristics:

1. length of migration zone 12″.

2. slope of migration zone 10:1 (vertical: horizontal).
3. length of retention zone 6".
4. length of lip zone 2".
5. slope of lip zone 10:1 (vertical:horizontal).
6. diameter at mid-point of migration zone 8.8".
7. diameter at retention zone 10".
8. diameter at upper edge of lip zone 9.4".

The slurry processed was approximately seventy percent water by weight, twenty-eight percent sand, two percent magnetite and was fed at rates of five tons per hour and thirteen tons per hour. A small quantity of gold was added to the slurry to test the efficiency of the device. It was found that in the case of gold particles having a size less than one millimeter, ninety percent of the gold was recovered at the five ton per hour throughput, and fifty to seventy percent was recovered at the thirteen ton per hour throughput. For gold particles having a size between one and two millimeters diameter, ninety-five percent of the gold was recovered at the lower throughput, and eighty-five to ninety-five percent recovered at the higher volume throughput. Similar tests were also conducted using coarser gold particles at a throughput varying from eleven to thirteen tons per hour, and it was found that all gold particles were recovered.

While a large number of variables are at work in determining the optimum geometry of the drum, various theoretical approximations may be made to arrive at the most appropriate range of slopes for the migration zone to arrive at the desired gold retention. The applicant has calculated that for the optimum migration characteristics, the tangent of the angle a, which is the angle between a plane perpendicular to the axis of rotation and migration zone surface, should be greater than or equal to A/[f(A-B)] and less than or equal to A/[N-f(A-B)] where A equals the specific gravity of the solids, B equals the specific gravity of water, N equals the fraction of slurry which is solids and f equals the co-efficient of kinetic friction of the wall surface at the applicable velocity. This expression applies when the solid particles are submerged only.

As will be apparent to persons skilled in the art, various modifications and adaptations of the structure above-described are possible without deparature from the spirit of the invention, the scope of which is defined in the appended claims. In particular, while the preferred embodiment has been described with a vertical axis of rotation, other orientations of the axis of rotation are possible.

The embodiments of the invention in which an exclusive property or privilege is claimed are defined as follows:

1. A concentrator for separating particulate material of higher specific gravity form particulate material of lower specific gravity comprising:

(a) a hollow drum having an open end and interior surface;
(b) means for rotatably supporting said drum on an axis;
(c) drive means for rotating said drum about said axis; and
(d) material supply means to deliver said particulate material into the end of said drum spaced from said open end;

wherein said interior surface of said drum comprises an outwardly inclined migration zone, a retention zone above said migration zone which is substantially parallel to said axis of rotation and an inwardly inclined lip zone above said retention zone, where said hollow drum comprises an open interior providing unobstructed delivery of said particulate material to said migration zone of said interior surface and where the respective lengths of said migration, retention and lip zones and the relative degrees of inclination of said migration and lip zones are selected to provide a sufficient component of force on said particulate material to expel said lighter particulate material from said drum and to permit said heavier particulate material to be retained in said retention zone.

2. The concentrator of claim 1 wherein said interior surface of said drum is substantially free of obstructions to the flow of said particulate material.

3. The concentrator of claim 1 wherein said axis of rotation is vertical.

4. The concentrator of claim 3 wherein the slope of said migration zone is approximately 10:1.

5. The concentrator of claim 4 wherein the slope of said lip zone is approximately 10:1.

6. The concentrator of claim 5 wherein the ratio of lengths of said migration zone, retention zone and lip zone are approximately 6:3:1 respectively.

7. The concentrator of claim 1 further comprising impeller means secured to said hollow drum in a location along the axis of said drum adjacent the end of said drum spaced from said open end.

8. The concentrator of claim 1 wherein said end of said drum spaced from said open end is provided with an aperture for removal of particulate material.

9. A concentrator for separating particulate material of higher specific gravity from particulate material of lower specific gravity comprising:

(a) a hollow drum having an open end and an interior surface;
(b) means for rotatably supporting said drum on an axis;
(c) drive means for rotating said drum about said axis; and
(d) material supply means to deliver said particulate material into the end of said drum spaced from said open end;

wherein said interior surface said drum comprises an outwardly inclined migration zone, a retention zone above said migration zone which is substantially parallel to said axis of rotation and an inwardly inclined lip zone above said retention zone, where said hollow drum comprises an open interior providing unobstructed delivery of said particulate material to said migration zone of said interior surface and where the respective lengths of said migration, retention and lip zones and the relative degrees of inclination of said migration and lip zones are selected to provide a sufficient component of force on said particulate material to expel said lighter particulate material from said drum and to permit said heavier particulate material to be retained in said retention zone, wherein the slope of said migration zone is greater than 5:1.

10. The concentrator of claim 9 wherein the slope of said lip zone is greater than 5:1.

* * * * *